US012601513B1

(12) United States Patent
Lin et al.

(10) Patent No.: US 12,601,513 B1
(45) Date of Patent: Apr. 14, 2026

(54) COOLING ASSISTANCE DEVICE AND FAN

(71) Applicant: GUANGDONG LUANSHENG ELECTRONIC TECHNOLOGY CO., LTD., Huizhou City (CN)

(72) Inventors: Yonggan Lin, Huizhou City (CN); Guoxing Wu, Huizhou City (CN)

(73) Assignee: GUANGDONG LUANSHENG ELECTRONIC TECHNOLOGY CO., LTD., Huizhou City (CN)

( * ) Notice: Subject to any disclaimer, the term of this patent is extended or adjusted under 35 U.S.C. 154(b) by 0 days.

(21) Appl. No.: 19/333,375

(22) Filed: Sep. 19, 2025

(30) Foreign Application Priority Data

Jul. 21, 2025 (CN) ..... 202511005888.2

(51) Int. Cl.
*F24F 6/14* (2006.01)
*F24F 5/00* (2006.01)
*F24F 6/00* (2006.01)

(52) U.S. Cl.
CPC ..... *F24F 6/14* (2013.01); *F24F 5/0035* (2013.01); *F24F 2006/008* (2013.01); *F24F 2006/143* (2013.01); *F24F 2221/12* (2013.01); *F24F 2221/38* (2013.01)

(58) Field of Classification Search
CPC ..... F24F 6/14; F24F 5/0035; F24F 2006/143; F24F 2221/12; F24F 2221/38
See application file for complete search history.

(56) References Cited

U.S. PATENT DOCUMENTS

2008/0047291 A1* 2/2008 Colwell ..... F24F 11/70 62/314
2008/0169575 A1* 7/2008 Chen ..... F24F 5/0035 261/78.2
2011/0139005 A1* 6/2011 Kwon ..... F24F 8/133 95/224
2023/0102091 A1* 3/2023 Kim ..... F04D 25/08 55/357

* cited by examiner

*Primary Examiner* — Elizabeth J Martin
(74) *Attorney, Agent, or Firm* — Li & Cai Intellectual Property Office

(57) ABSTRACT

A cooling assistance device and a fan, in the technical field of cooling apparatuses, include: a first main body, a second main body, and a gas source driving member. A first delivery channel is provided inside the first main body, and one side of the first main body is provided with a first delivery opening in communication with the first delivery channel. A second delivery channel is provided inside the second main body, and one side of the second main body is provided with a second delivery opening in communication with the second delivery channel. The gas source driving member is configured to increase a flow rate of gas inside the first delivery channel. The first delivery channel is configured to deliver airflow to the first delivery opening. When the airflow flows out from the first delivery opening, a negative pressure region is formed at the second delivery opening.

18 Claims, 17 Drawing Sheets

COOLING ASSISTANCE DEVICE AND FAN

CROSS-REFERENCE TO RELATED PATENT APPLICATION

This application claims the benefit of priority to China Patent Application No. 2025110058882, filed on Jul. 21, 2025, in the People's Republic of China. The entire content of the above identified application is incorporated herein by reference.

FIELD OF THE DISCLOSURE

The present disclosure relates to the technical field of cooling devices, and more particularly to a cooling assistance device and a fan.

BACKGROUND OF THE DISCLOSURE

A water-spraying cooling fan is a portable cooling device that integrates both misting and air-cooling functions, primarily used to address the limited cooling effectiveness of conventional fans in hot environments. Conventional fans rely solely on airflow to dissipate body surface heat, which often fails to achieve a significant cooling effect in high-temperature or dry environments. This is particularly the case in outdoor settings, places without air conditioning, or during physical activities, where users require a device that not only delivers airflow but also increases the local air humidity.

Conventional water-spraying fans utilize a water pump to spray water. However, the water sprayed by such water pumps typically forms liquid water columns or coarse mist droplets, making it difficult to achieve a fine and uniform atomization effect, which may compromise the comfort of use, especially when directed toward the user's face.

SUMMARY OF THE DISCLOSURE

The present disclosure aims to address the shortcomings and deficiencies in the prior art by providing a cooling assistance device and a fan, which at least solves one of the aforementioned technical problems, and has the advantage of generating a finer water mist.

To achieve the above objective, the present disclosure provides a cooling assistance device and a fan, including: a first main body, wherein a first delivery channel is provided inside the first main body, and a first delivery opening in communication with the first delivery channel is provided on one side of the first main body; and a second main body, wherein a second delivery channel is provided inside the second main body, and a second delivery opening in communication with the second delivery channel is provided on one side of the second main body; wherein the first delivery channel is configured to deliver compressed airflow to the first delivery opening, and when the compressed airflow flows out from the first delivery opening, a negative pressure region is formed at the second delivery opening such that water flow inside the second delivery channel flows out from the second delivery opening and is impinged to form mist by the compressed airflow flowing out from the first delivery opening.

Compared with the prior art, the advantages of the present disclosure are as follows.

The present disclosure provides a structure including a first main body and a second main body. The first main body is internally provided with the first delivery channel, and one side of the first main body is provided with the first delivery opening in communication with the first delivery channel. The second main body is internally provided with the second delivery channel, and one side of the second main body is provided with the second delivery opening in communication with the second delivery channel. When a compressed airflow is delivered to the first delivery channel by an air pump, the compressed airflow is discharged at high speed from the first delivery opening to form a jet stream. As the compressed airflow passes the location of the second delivery opening, a localized low-pressure region is formed. The resulting pressure differential automatically draws water from the second delivery channel to the second delivery opening, where the airflow and the atomized water stream mix outside the outlet to form a fine mist that diffuses with the airflow, so as to achieve synergistic cooling through gas-liquid two-phase flow. Since the gas source driving member does not come into direct contact with the water, it avoids common issues found in conventional water pumps, such as scale buildup, clogging, and bearing corrosion, thereby resulting in longer service life and lower maintenance cost.

BRIEF DESCRIPTION OF THE DRAWINGS

To more clearly illustrate the technical solutions in the embodiments of the present disclosure or in the prior art, the following is a brief introduction to the drawings required in the description of the embodiments or prior art. It is evident that the drawings described below are merely embodiments of the present disclosure, and those skilled in the art may derive other drawings based on the provided figures without any creative effort.

REFERENCE NUMERALS

Figure 1:
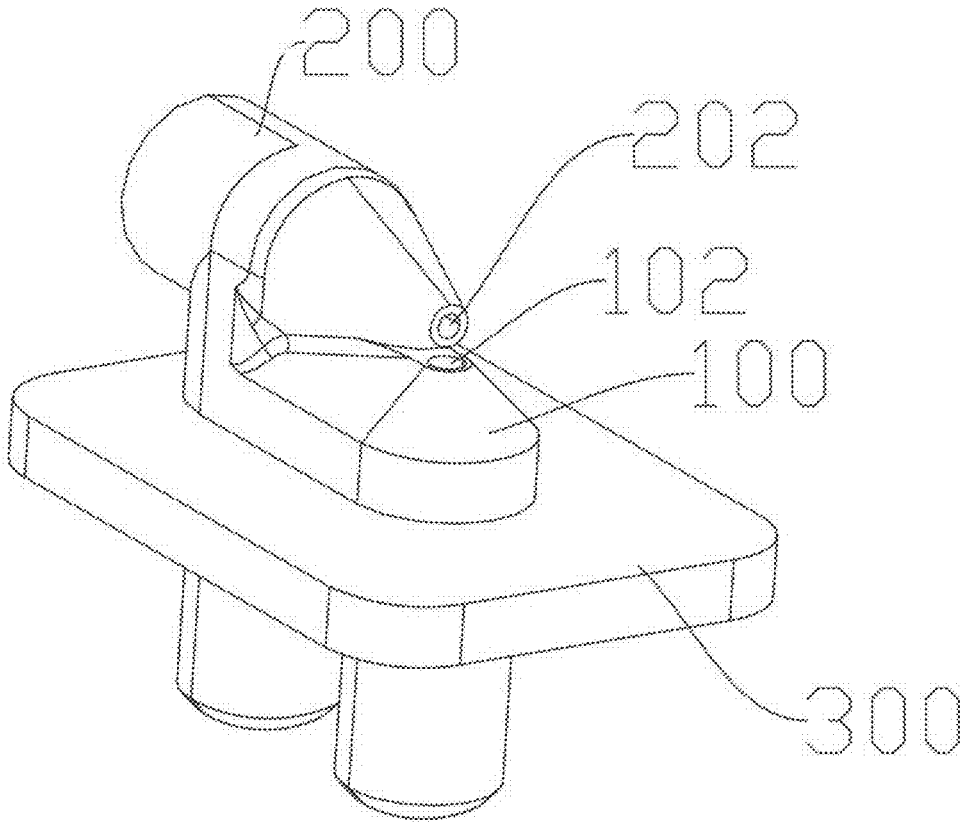
FIG. 1 is a schematic isometric view of a partial structure of a cooling assistance device according to an embodiment of the present disclosure.
Figure 2:
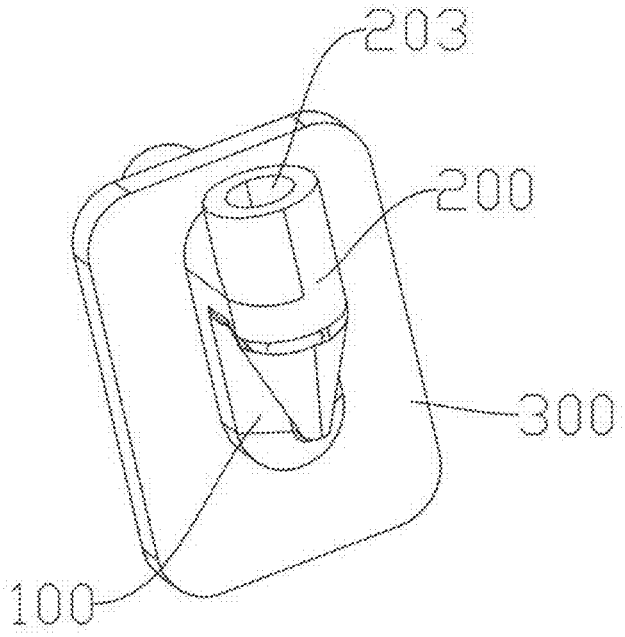
FIG. 2 is a schematic isometric view from another angle of the partial structure of the cooling assistance device according to an embodiment of the present disclosure.
Figure 3:
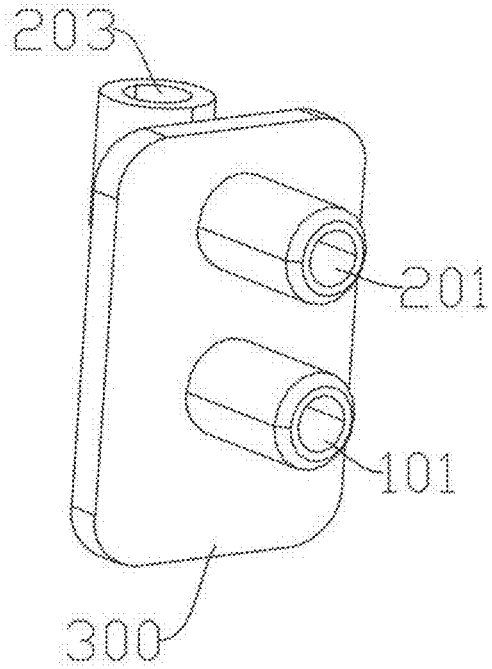
FIG. 3 is a schematic rear view of the partial structure of the cooling assistance device according to an embodiment of the present disclosure.
Figure 4:
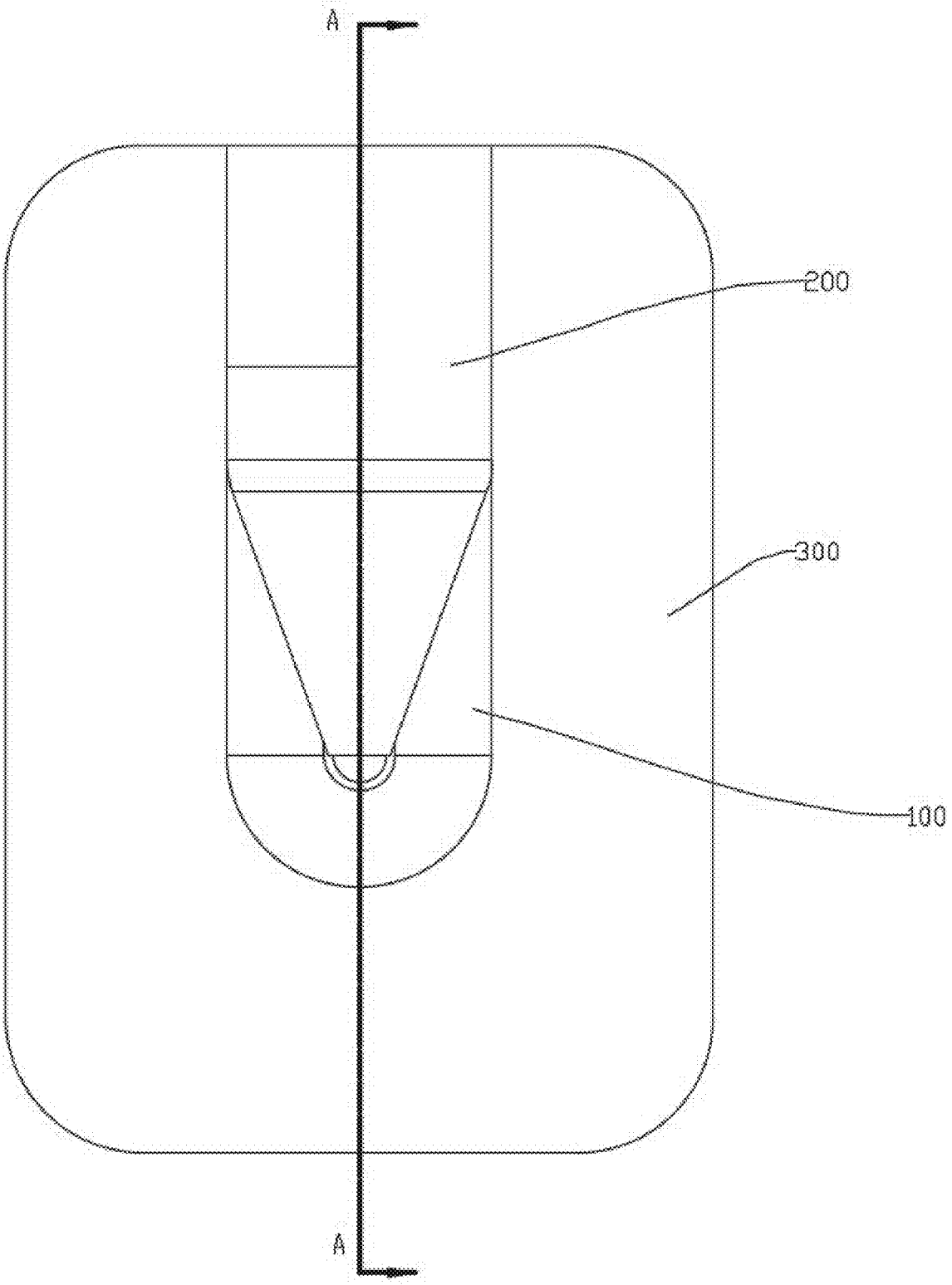
FIG. 4 is a schematic front view of the partial structure of the cooling assistance device according to an embodiment of the present disclosure.

100: first main body; 101: first delivery channel; 102: first delivery opening; 200: second main body; 201: second delivery channel; 202: second delivery opening; 203: third delivery channel; 300: mounting plate; 410: fourth delivery channel; 420: fifth delivery channel; 430: first sleeve; 440: second sleeve; 510: first delivery portion; 520: second delivery portion; 600: first assembly member; 601: first mounting portion; 602: second mounting portion; 603: first mounting post; 604: clearance through hole; 700: second assembly member; 701: second mounting post; 801: fan main body; 802: first air-blowing component; 803: second air-blowing component; 804: airflow delivery device; 805: water source delivery device; 806: water source storage device; 807: gas source driving member; 810: end casing; 81: first air outlet; 812: second air outlet; 813: first mounting through hole; 814: second mounting through hole; 820: mounting cover; 821: diversion groove; 822: third mounting through hole.

DETAILED DESCRIPTION OF THE EXEMPLARY EMBODIMENTS

The technical solutions of the embodiments of the present disclosure will now be clearly and completely described in conjunction with the accompanying drawings in the embodiments of the present disclosure. It is obvious that the described embodiments are merely a part of the embodiments of the present disclosure, rather than all embodiments. Based on the embodiments of the present disclosure, all other embodiments obtained by those skilled in the art without creative effort fall within the scope of protection of the present disclosure.

It should be noted that the terms "center," "longitudinal," "lateral," "upper," "lower," "front," "rear," "left," "right," "top," "bottom," "inner," "outer," "back," "side," "circumferential," and the like used in the present disclosure refer to orientation or positional relationships based on those shown in the drawings, which are merely for the purpose of describing the present disclosure and simplifying the description, and do not indicate or imply that the referred device or element must have a specific orientation, be constructed or operated in a specific orientation, and therefore should not be construed as limiting the present disclosure. In addition, terms such as "first" and "second" are used merely to distinguish between multiple components or structures having the same or similar configurations and are not indicative of any particular order or connection relationship.

Referring to FIGS. 1 to 17, an embodiment of the present disclosure provides a cooling assistance device and a fan. The present disclosure proposes a cooling assistance device including a first main body 100 and a second main body 200. A first delivery channel 101 for delivering compressed airflow is provided inside the first main body 100, and a first delivery opening is formed at a side of the first main body 100. A second delivery channel 201 for delivering water flow is provided inside the second main body 200, and a second delivery opening is formed at a side of the second main body 200. When high-speed compressed airflow flows out from the first delivery opening, a negative pressure region is formed at the second delivery opening, so that water flow in the second delivery channel 201 is ejected from the second delivery opening 202 and is impinged to form mist by the compressed airflow flowing out from the first delivery opening.

The first delivery channel 101 refers to a fluid passage passing through the main body, which can be implemented as a hollow tubular structure for guiding the compressed air in a directional flow. The second delivery channel 201 refers to a liquid passage connected to a water source storage device 806, and the second delivery channel 201 may be implemented as an independent tube cavity structure. An outlet of the second delivery channel 201 forms a spatial fit with the first delivery opening. The negative pressure region refers to a low-pressure area generated when high-speed airflow passes through a specific structure, and the negative pressure effect can be enhanced by adjusting an included angle between central axes of the two channel outlets. Specifically, a gas source driving member 807 is an air pump, which may have a power of 4 watts. When the air pump delivers the compressed air to the first channel, the airflow is ejected at high speed from the first delivery opening to form a jet stream. According to Bernoulli's principle, a localized low-pressure area is formed when the high-speed airflow is passing by the second delivery opening, such that water is automatically drawn through the second delivery channel to the second delivery opening, where it is then atomized into fine mist by the airflow and diffused along with the airflow, thereby achieving gas-liquid two-phase synergistic cooling. The compressed airflow refers to gas whose flow rate is increased by the air pump. Furthermore, conventional small fans may include an atomizing plate to achieve finer mist dispersion. Although the atomizing plate can enhance the fineness and uniformity of mist to a certain extent, it suffers from two significant disadvantages. One of the disadvantages is that the microporous structure of the atomizing plate is prone to mechanical blockage caused by impurities such as limescale in water, resulting in decreased atomization efficiency or complete failure, and the other disadvantage is that long-term high-frequency vibration under continuous power supply can also damage the atomizing plate. The present disclosure eliminates the atomizing plate while still achieving fine mist formation, thus ensuring a comfortable user experience when mist is sprayed onto the face, and fundamentally eliminating performance degradation issues caused by microporous clogging or fatigue damage due to vibration, thereby significantly improving product reliability and service life.

In the present embodiment, an end portion of the second main body is located in front of the first delivery opening and is configured to partially block the first delivery opening. The central axis of the first delivery opening and the central axis of the second delivery opening have the included angle therebetween. Furthermore, the end portion of the second main body is located in front of the first delivery opening and is configured to block half of the first delivery opening, so that the size and position of the negative pressure region are more appropriate, ensuring that the negative pressure region can precisely act on the water flow part of the second delivery channel, thereby improving the atomization effect and enhancing the cooling efficiency. The central axis of the first delivery opening 102 is perpendicular to the central axis of the second delivery opening 202. The central axis refers to geometric centerlines of the first delivery opening and the second delivery opening in space. Perpendicular setting means that the central axes of the first delivery opening and the second delivery opening form a 90-degree angle, which can be achieved through orthogonal pipe layouts. Specifically, when the high-speed airflow is ejected vertically from the first delivery opening 102, its flow direction forms a spatial orthogonal relationship with the water flow ejected from the second delivery opening 202. This layout causes the airflow to form an annular negative pressure region outside the second delivery opening 202, and the water flow is accelerated and torn into fine droplets under the negative pressure effect.

In the present embodiment, apertures of the first delivery opening and the second delivery opening are both less than 2 mm. Optionally, the aperture of the first delivery opening is 0.5 mm, and the aperture of the second delivery opening is 0.4 mm.

Referring to FIGS. 1 to 8, in the present embodiment, a mounting plate 300 is further provided. The first main body 100 is integrally formed on the mounting plate 300, and the second main body 200 is either integrally formed on the mounting plate 300 or integrally formed on the first main body 100. The mounting plate 300 refers to a supporting structure for carrying the main bodies, which may be implemented as a plastic substrate formed by injection molding, and the planar dimensions thereof may be adjusted according to the layout requirements of the main bodies. "Integrally formed" refers to the process of fusing different components into a single structure using mold injection technology, and may specifically be implemented by two-color injection molding or insert injection molding. This process eliminates assembly gaps in traditional structures and enhances sealing performance. Specifically, when molten material is injected into the mold, the first main body 100 and the mounting plate 300 are combined to form a seamless integral structure. The second main body 200 may optionally be molded directly with the mounting plate 300 or formed as an extension of the first main body 100. At an intersection of the airflow delivery channel and the water flow delivery channel, the integral molding process can eliminate the assembly errors that exist in traditional split-type structures. The present embodiment further includes a battery for supplying power to various components within the fan.

Figure 5:
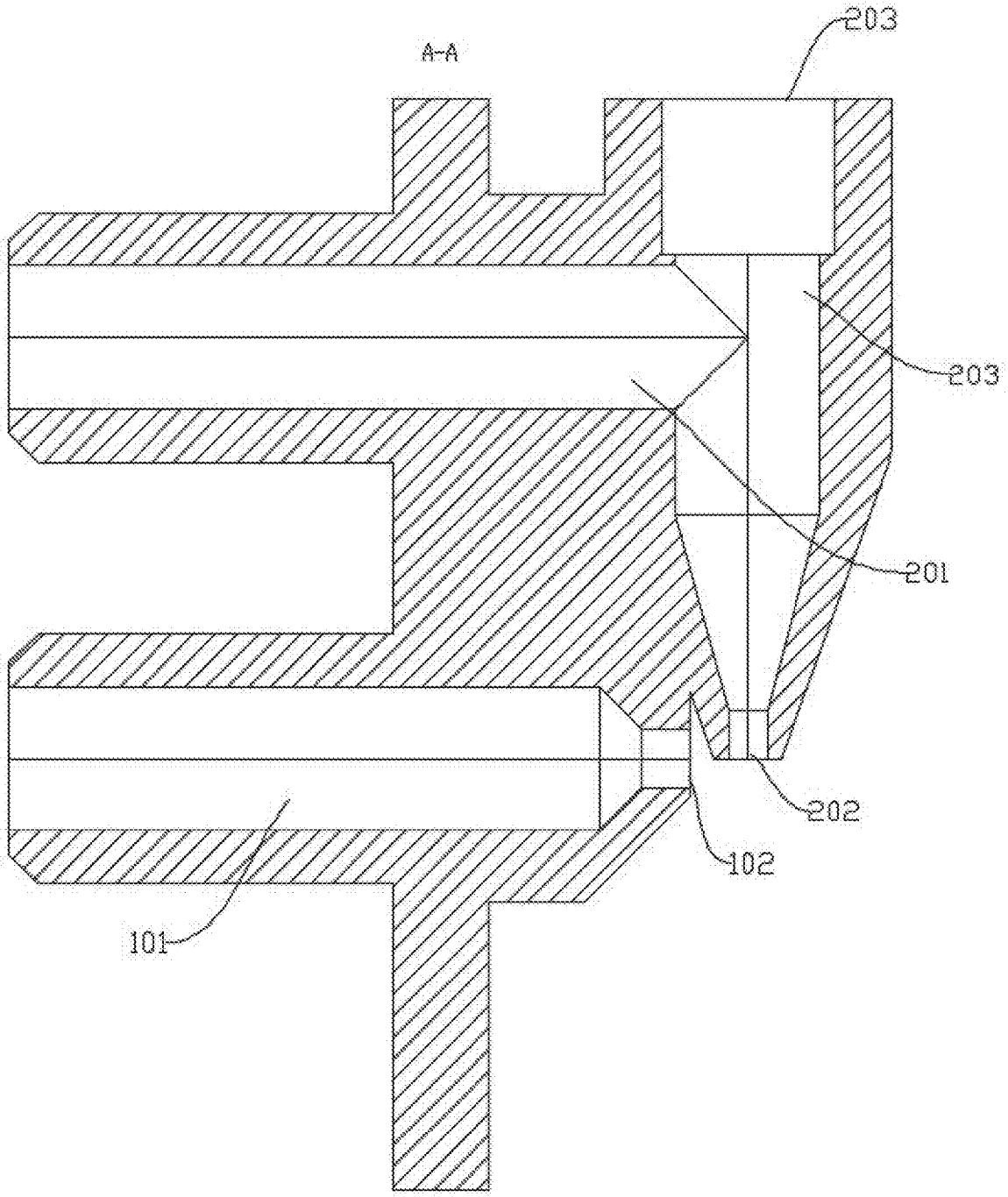
FIG. 5 is a schematic sectional view taken along line A-A in FIG. 4 of the partial structure of the cooling assistance device according to an embodiment of the present disclosure.
Figure 6:
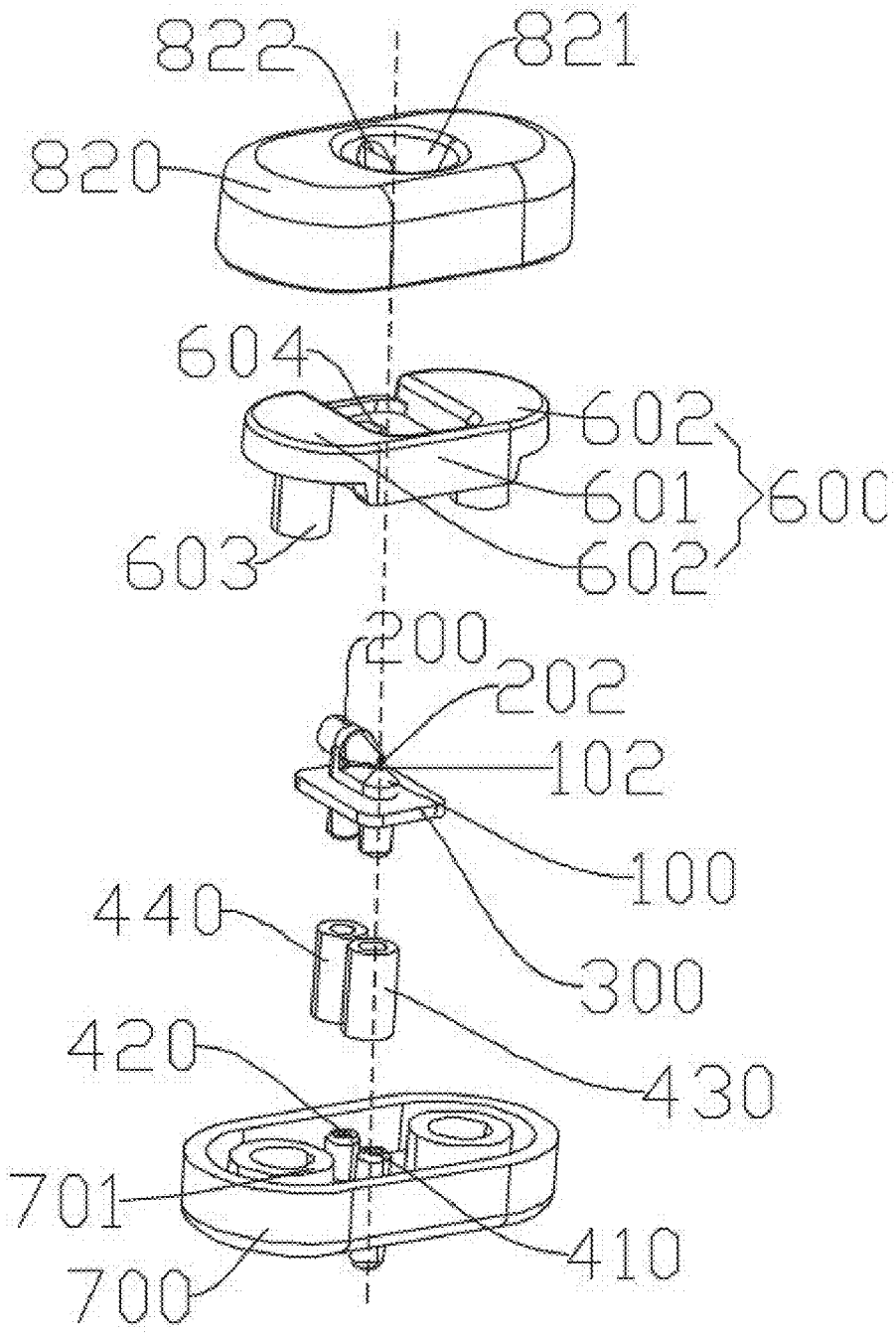
FIG. 6 is a schematic exploded view of the cooling assistance device according to an embodiment of the present disclosure.
Figure 7:
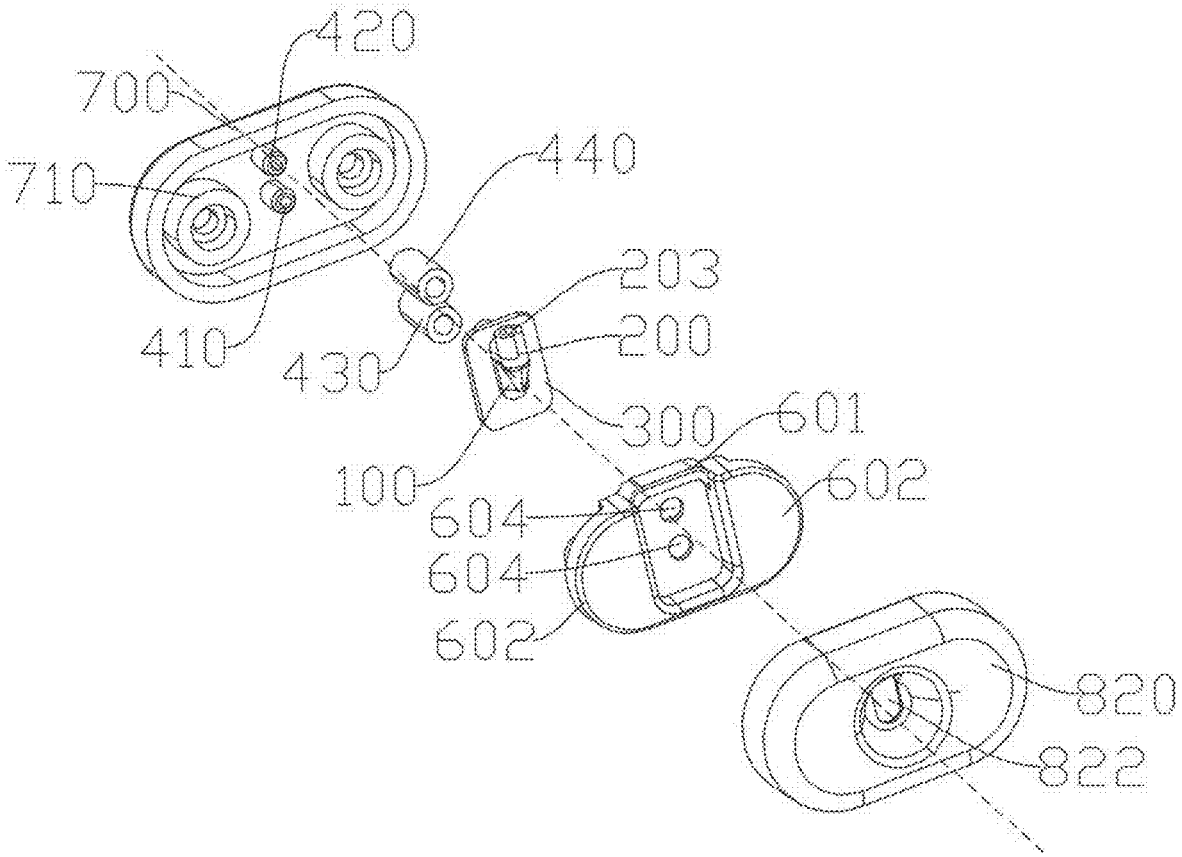
FIG. 7 is another schematic exploded view from a different angle of the cooling assistance device according to an embodiment of the present disclosure.
Figure 8:
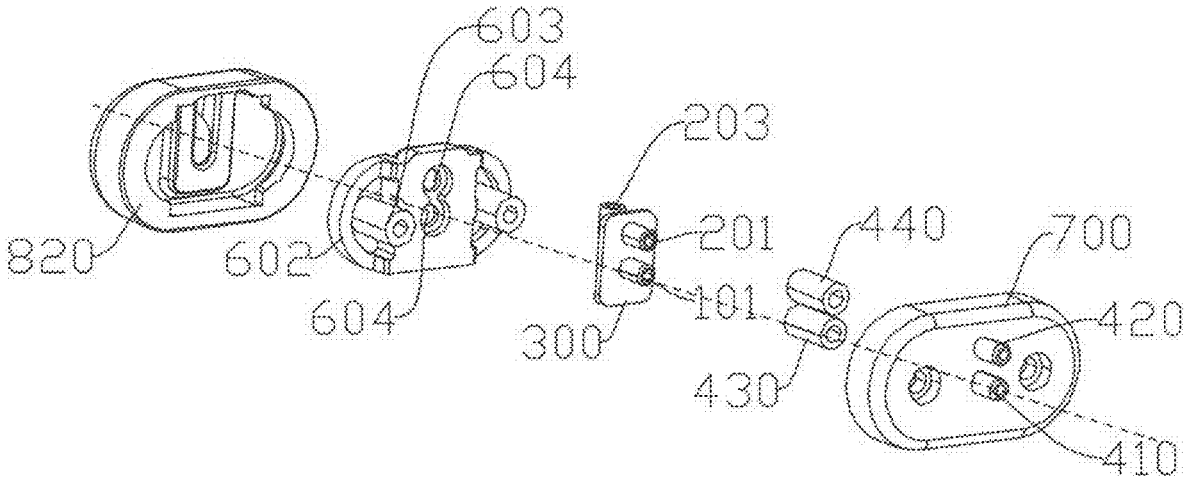
FIG. 8 is a further schematic exploded view from another angle of the cooling assistance device according to an embodiment of the present disclosure.
Figure 9:
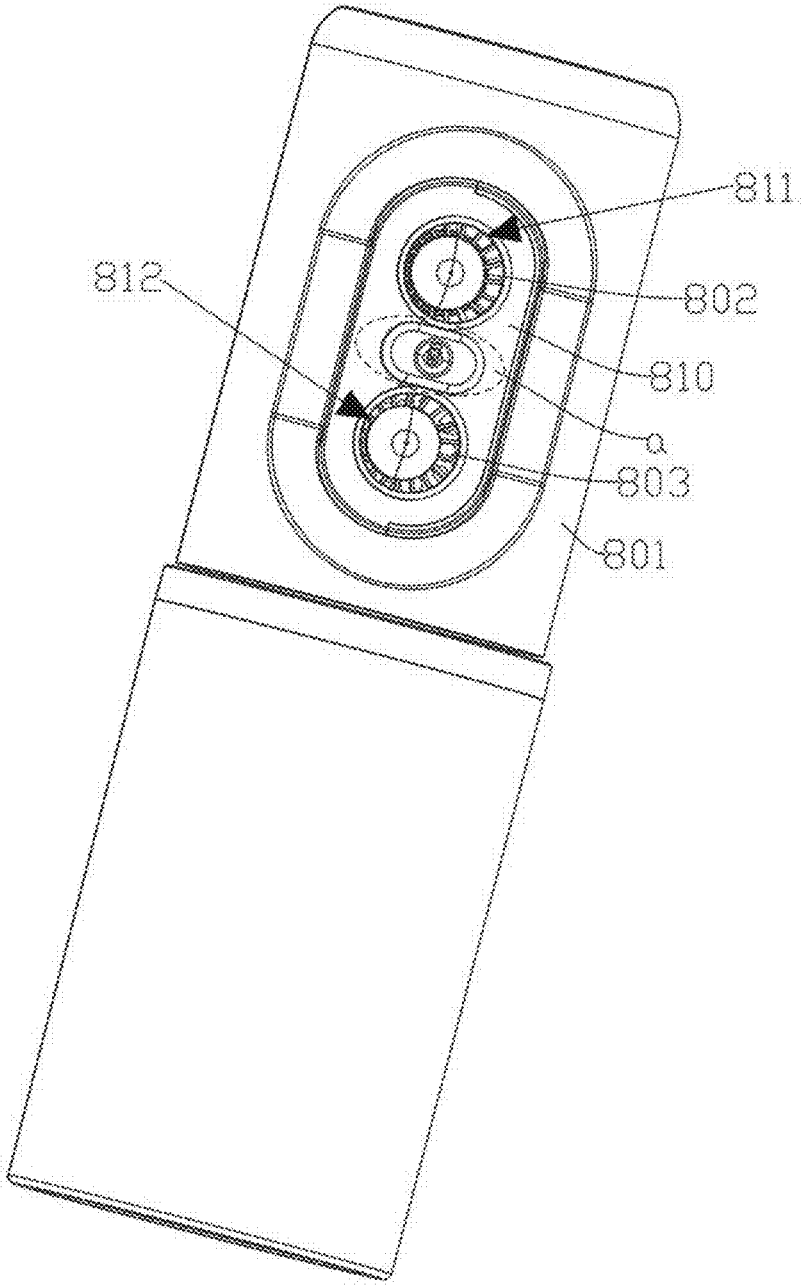
FIG. 9 is a schematic isometric view of a fan according to an embodiment of the present disclosure.
Figure 10:
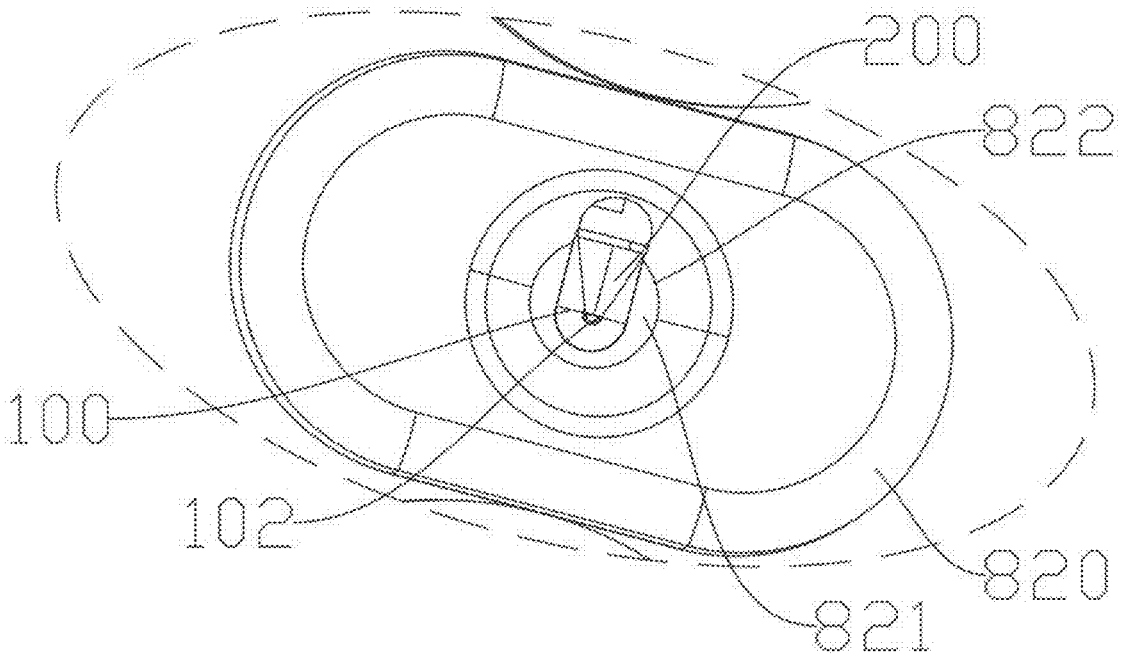
FIG. 10 is a schematic partially enlarged view of section a in FIG. 9 according to an embodiment of the present disclosure.
Figure 11:
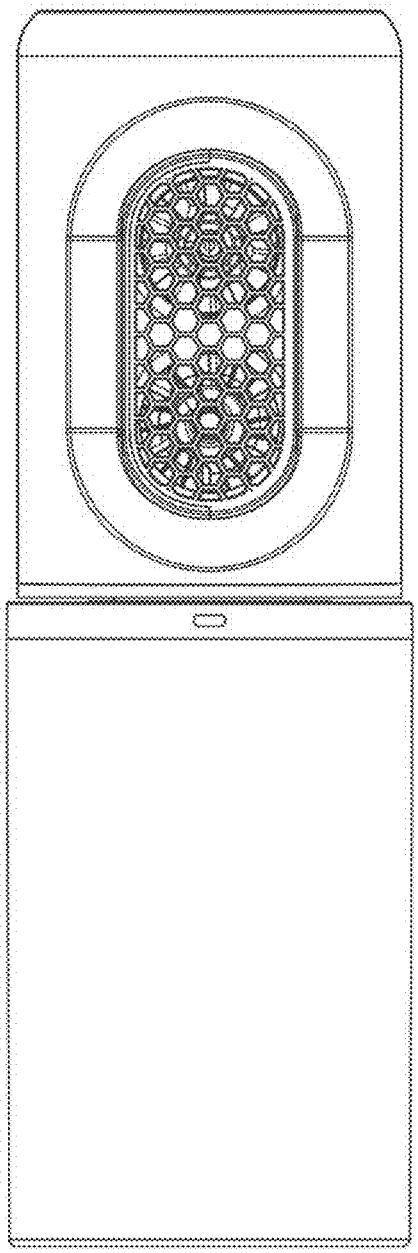
FIG. 11 is a schematic rear view of the fan according to an embodiment of the present disclosure.
Figure 12:
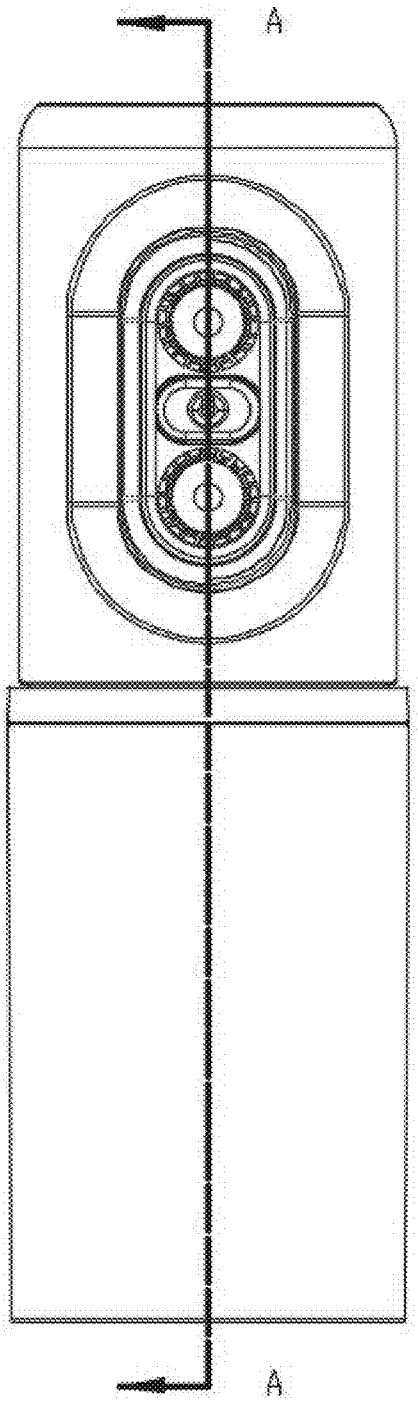
FIG. 12 is a schematic front view of the fan according to an embodiment of the present disclosure.
Figure 13:
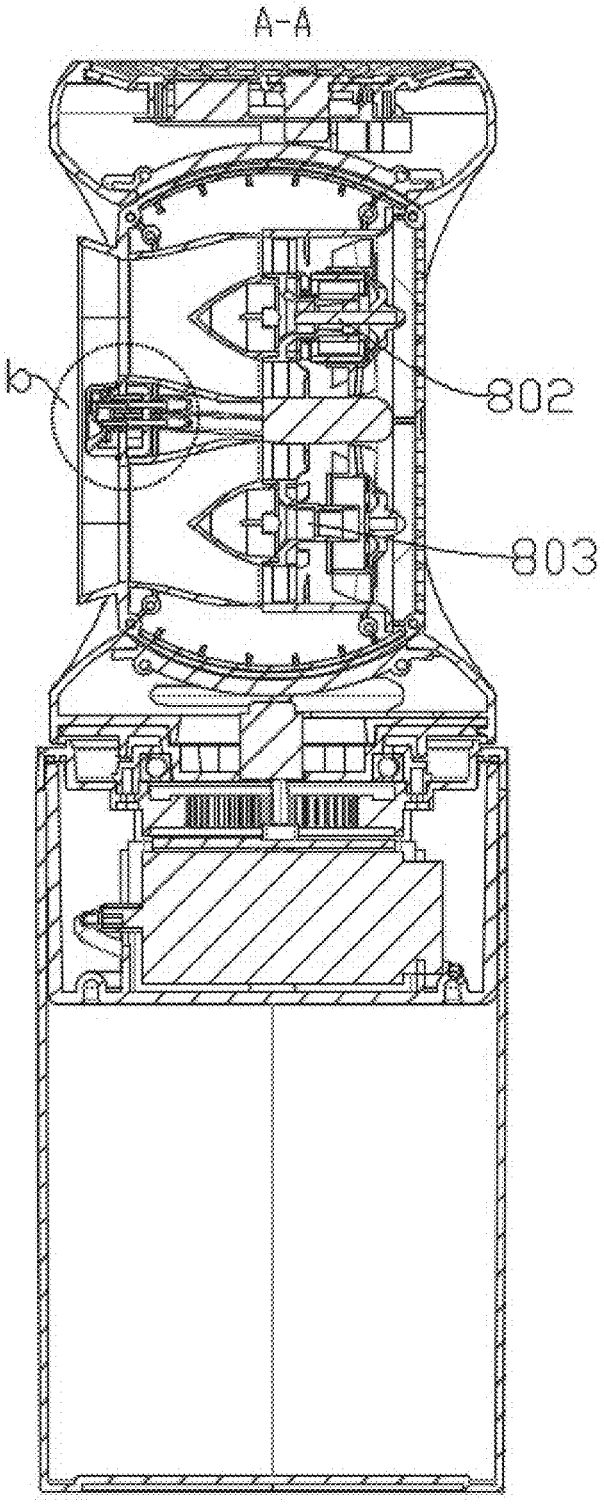
FIG. 13 is a schematic sectional view taken along line A-A in FIG. 12 according to an embodiment of the present disclosure.
Figure 14:
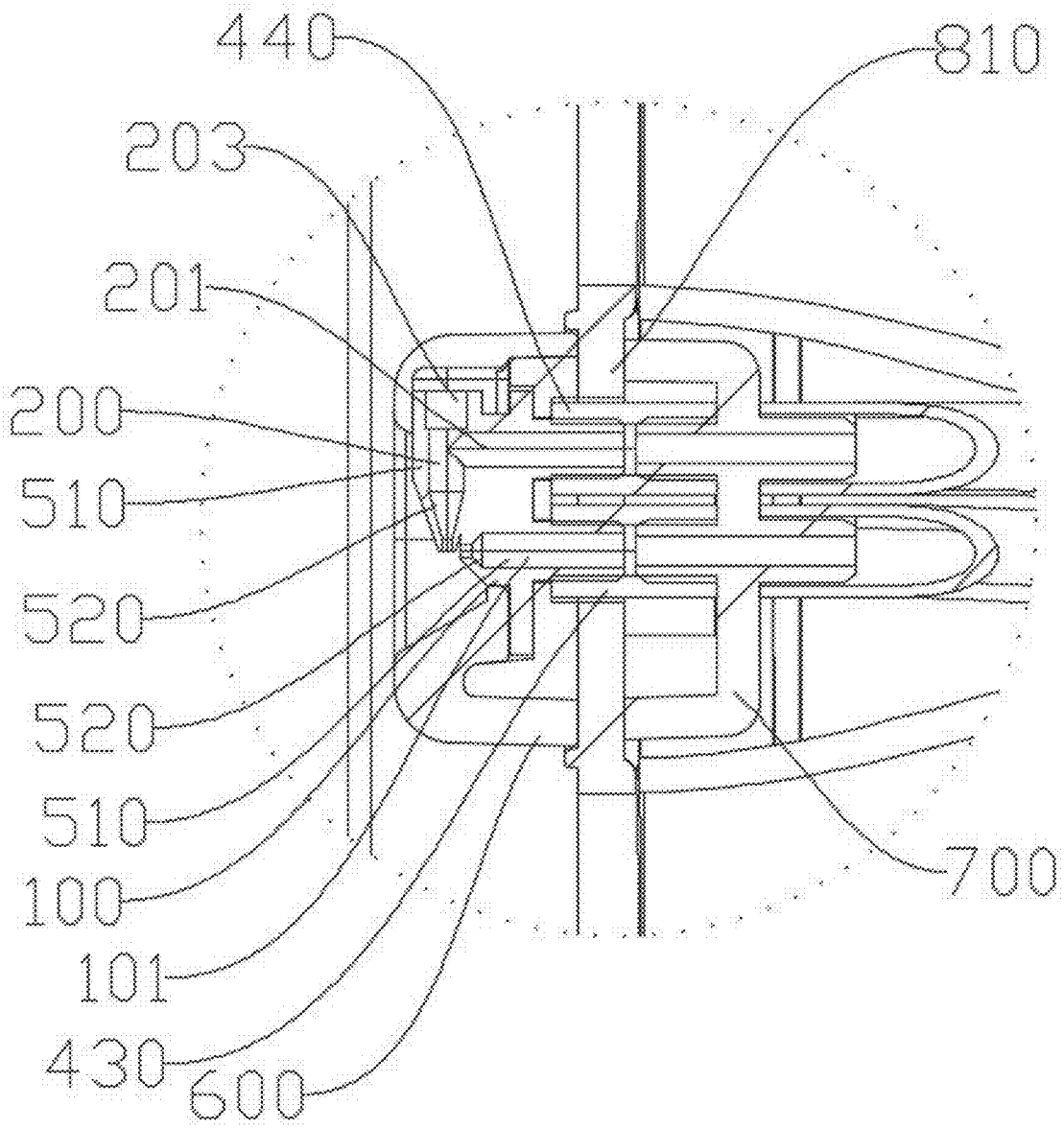
FIG. 14 is a schematic partially enlarged view of section b in FIG. 13 according to an embodiment of the present disclosure.
Figure 15:
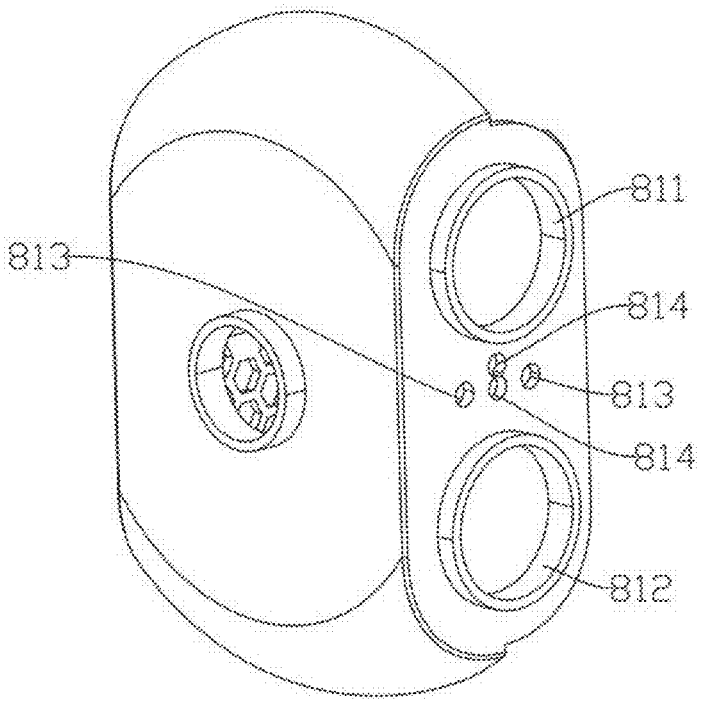
FIG. 15 is a schematic isometric view of an end casing according to an embodiment of the present disclosure.
Figure 16:
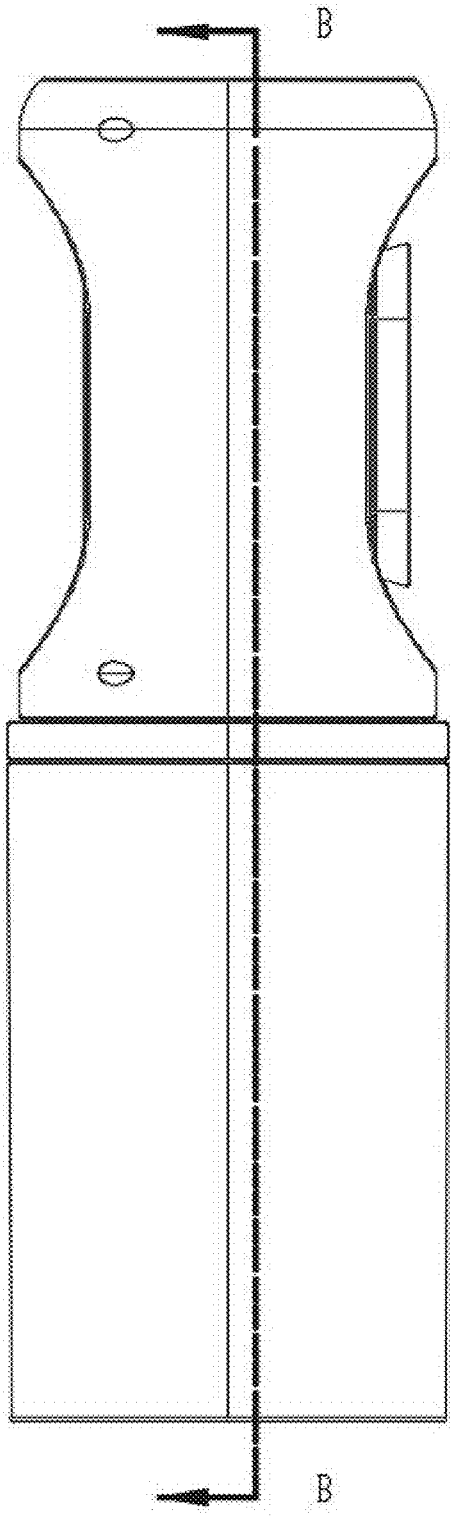
FIG. 16 is a schematic side view of the fan according to an embodiment of the present disclosure.
Figure 17:
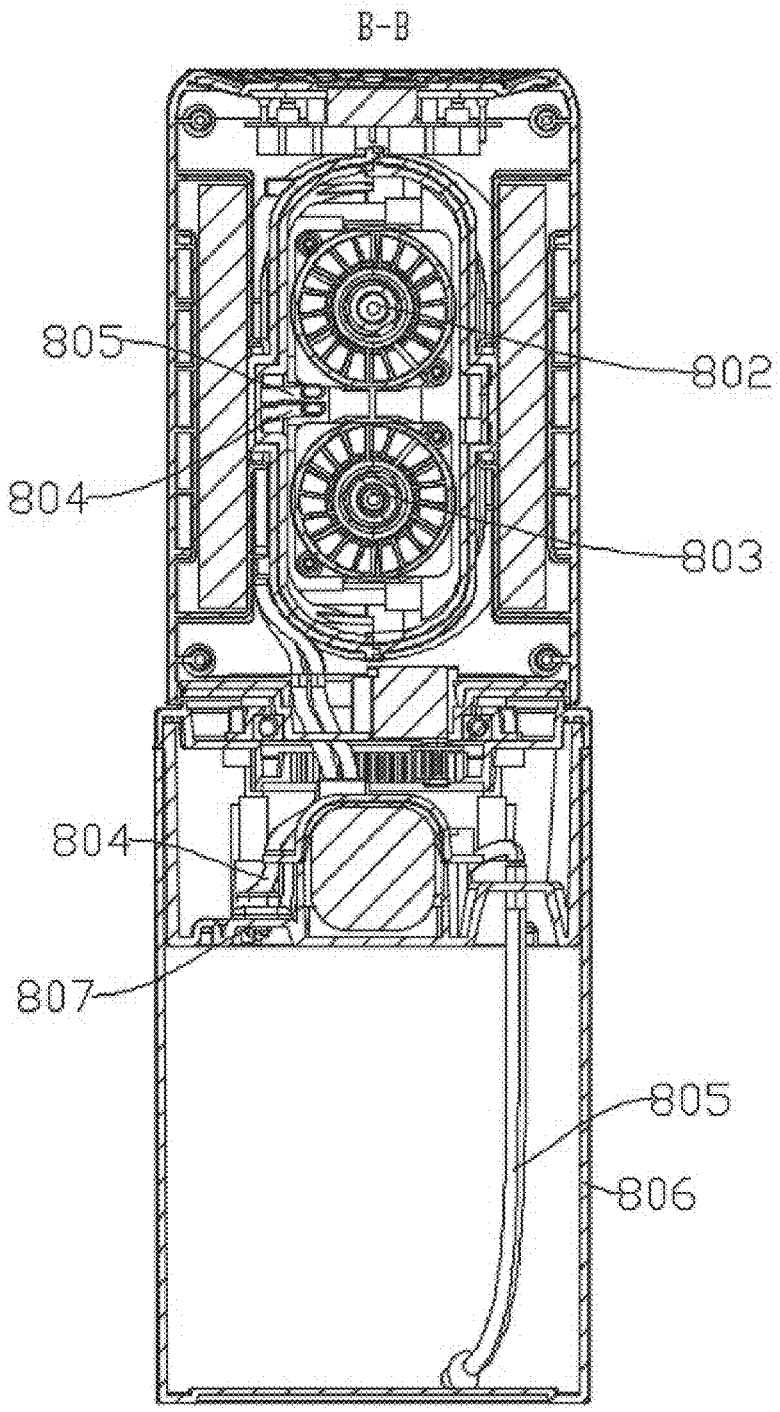
FIG. 17 is a schematic sectional view taken along line B-B in FIG. 16 according to an embodiment of the present disclosure.

Referring to FIG. 5 and FIG. 14, in the present embodiment, it is further proposed that both the first delivery channel 101 and the second delivery channel 201 include a portion 510 in a columnar shape and a second delivery portion 520 in a conical shape, where the second delivery portion 520 is connected to the first delivery opening 102 and the second delivery opening 202.

The first delivery portion 510 in the columnar shape refers to a fluid guiding structure with a cylindrical cross-sectional shape, which may specifically be implemented using a metal tube or plastic tube with a smooth inner wall. The second delivery portion 520 in the conical shape refers to a guiding structure in which a cross-sectional diameter gradually decreases in a direction of fluid flow.

Specifically, the first delivery portion 510 in the columnar shape is used to receive and stably deliver the airflow or water flow, while the second delivery portion 520 in the conical shape increases the flow speed of the fluid by means of a reduced cross-sectional area. When the airflow enters the conical section from the columnar section of the first delivery channel 101, the flow speed increases and a high-speed jet stream is formed at the first delivery opening 102. The negative pressure region generated by this jet stream causes the water flow in the second delivery channel 201 to be drawn in and mixed. The columnar section of the second delivery channel 201 can maintain stable delivery of the water flow, while the conical section enhances the mixing effect with the airflow by accelerating the water flow.

In the present embodiment, a cooling assistance device is further provided, in which a top of the second main body 200 is provided with a third delivery channel 203 that communicates with the second delivery channel 201. The second delivery channel 201 and the third delivery channel 203 are in fluid communication with the water source storage device 806 through a water source delivery device 805.

The third delivery channel 203 refers to an auxiliary water flow passage provided at the top of the second main body 200, which may be implemented using an independent pipe or a branch channel formed with a shared wall with the second delivery channel 201, and is used to extend the water delivery path. The water source delivery device 805 refers to a fluid conduction mechanism that connects the delivery channels with the water storage container, which may specifically be implemented using a sleeve. The water source storage device 806 refers to a container that stores cooling liquid, which may specifically be implemented as a detachable water tank or a built-in liquid storage cavity, thereby facilitating the replenishment and replacement of cooling medium.

Specifically, when the negative pressure is formed in the second delivery channel 201, the third delivery channel 203 may simultaneously generate a siphon effect to allow the water from the water source storage device 806 to be drawn into the delivery channels through the water source delivery device 805. The two delivery channels may operate independently or cooperatively. For example, under a low water volume condition, only the second delivery channel 201 may be activated, while under a high-load condition, both channels may be activated simultaneously to increase the water delivery volume. The water flow is atomized and ejected in combination with the airflow under the action of negative pressure.

In the present embodiment, the first delivery channel 101 is further proposed to be in fluid communication with the air pump through the airflow delivery device 804.

The airflow delivery device 804 refers to a communication structure for connecting the air pump with the first delivery channel 101. It may specifically be implemented using a hose or a rigid pipe, and functions to directionally deliver the airflow generated by the air pump to the first delivery channel 101. The air pump refers to a device for generating airflow power, which may specifically be implemented using an electric air pump, and functions to provide a continuous and stable airflow input to the first delivery channel 101. Specifically, the use of an air pump as a power source in place of a traditional water pump avoids direct contact between the water flow and the power device, thereby reducing the risk of component corrosion.

Referring to FIGS. 1 to 8, in the present embodiment, a cooling assistance device is further proposed, including a first assembly member 600 and a second assembly member 700. The first assembly member 600 has a first mounting portion 601 for mounting the mounting plate 300, and second mounting portions 602 respectively arranged on opposite sides of the first mounting portion 601. A first mounting post 603 is disposed on a side of the second mounting portion 602 near the second assembly member 700. A second mounting post 701 is disposed on a side of the second assembly member 700 near the first assembly member 600. The first mounting post 603 may be inserted into the second mounting post 701. The first mounting portion 601 is recessed to form a groove for mounting the mounting plate 300.

The first mounting post 603 refers to a columnar connection component provided on the side of the second mounting portion 602 and may specifically be implemented as a cylindrical or square-column metal component, used to form an insertion fit with the second mounting post 701. The second mounting post 701 refers to a corresponding connection component provided on the side of the second assembly member 700 and may specifically be implemented as a hollow sleeve or a post with a groove to receive the insertion of the first mounting post 603. The insertion fit refers to a fixed connection between two assembly components achieved through mechanical fitting of the post and sleeve or groove, without the need for additional fasteners.

Specifically, the first mounting posts 603 on the two sides of the second mounting portion 602 are connected with the second mounting posts 701 of the second assembly member 700 by means of insertion. When the first mounting post 603 is inserted into the second mounting post 701, a stable mechanical connection is formed between the two assembly components, while maintaining the communication between the first delivery channel 101 and the second delivery channel 201. In the present embodiment, a threaded hole is provided at the center of the first mounting post 603, and a through hole is provided in the second mounting post 701. A screw may pass through the through hole and be threadedly connected to the threaded hole.

Referring to FIGS. 1 to 15, in the present embodiment, the cooling assistance device further includes the first assembly member 600 and the second assembly member 700. The first assembly member 600 is provided with a clearance through hole 604 for avoiding the first delivery channel 101 and the second delivery channel 201. The second assembly member 700 is provided with a fourth delivery channel 410 facing the first delivery channel 101 and a fifth delivery channel 420 facing the second delivery channel 201. The first delivery channel 101 is in communication with the fourth delivery channel 410 through a first sleeve 430, and the second delivery channel 201 is in communication with the fifth delivery channel 420 through a second sleeve 440.

The clearance through hole 604 refers to a through hole set on the assembly component for avoiding interference with fluid channels, which may be implemented as a circular or rectangular hole, providing an independent space for fluid channels to avoid structural interference. The fourth delivery channel 410 and the fifth delivery channel 420 are extended flow paths corresponding to the first delivery channel 101 and the second delivery channel 201, respectively, and serve to provide directional fluid transmission. The first sleeve 430 and the second sleeve 440 are sealing connectors for connecting different flow paths, and may specifically be implemented using flexible rubber or silicone hoses, serving to compensate for assembly errors through flexible connection and to prevent fluid leakage.

Specifically, the clearance through hole 604 in the first assembly member 600 provides independent through-spaces for the airflow and water flow channels. The fourth delivery channel 410 of the second assembly member 700 and the first delivery channel 101 form a continuous airflow path through the first sleeve 430. The fifth delivery channel 420 and the second delivery channel 201 form a continuous water flow path through the second sleeve 440. During assembly, the sleeves are pressed onto the corresponding flow path ports of the two assembly components, so as to form a sealed and detachable connection structure.

Referring to FIGS. 1 to 15, in the present embodiment, a fan is further proposed, which includes the cooling assistance device. A fan main body 801 includes a first air-blowing component 802 and a second air-blowing component 803 arranged from top to bottom in sequence, and the cooling assistance device is disposed between the first air-blowing component 802 and the second air-blowing component 803.

The first air-blowing component 802 refers to an independent air-supply module located in an upper portion of the fan main body 801, which may specifically be implemented using an axial flow fan or a centrifugal fan, and is used to generate directional airflow. The second air-blowing component 803 refers to an independent air-supply module located in a lower portion of the fan main body 801, which may specifically adopt the same or different structure as the first air-blowing component 802, and is used to enhance the coverage of airflow. In the present embodiment, the water source storage device 806 is a bucket or a water tank, which is clamped at the bottom of the fan main body.

In the present embodiment, an end casing 810 is further proposed, and the end casing 810 is disposed at an air outlet end of the fan main body 801. The end casing 810 is provided with a first air outlet 811 for air output from the first air-blowing component 802, a second air outlet 812 for air output from the second air-blowing component 803, a first mounting through hole 813 for the passage of the first mounting post 603 and the second mounting post 701, and a second mounting through hole 814 for a corresponding sleeve to pass through. A mounting cover 820 is disposed on a side of the end casing 810 away from the first air-blowing component and the second air-blowing component. A diversion groove 821 is provided in a middle portion of the mounting cover 820, and third mounting through holes 822 are provided on the bottom and side walls of the diversion groove 821 for the passage of the first main body 100 and the second main body 200.

The end casing 810 refers to a plate-like structure covering the air outlet end of the fan main body 801, which may specifically be implemented using an injection molding process, and is used to integrate the air outlets and the mounting structure to achieve directional guidance of airflow. The mounting cover 820 refers to a housing structure disposed on an outer side of the end casing 810, used to protect internal components and form a flow-guiding space. The diversion groove 821 refers to a recessed structure located in the middle portion of the mounting cover 820, which may specifically be implemented by mold stamping or cutting processing, and is used to adjust the spray path of the mixed airflow and water flow. The third mounting through hole 822 refers to through holes provided on the bottom and side walls of the diversion groove 821, which may specifically be implemented by drilling or laser cutting processes, and is used to fix the positions of the first main body 100 and the second main body 200 to ensure coordinated spraying of the water flow and the airflow. Specifically, the end casing 810 guides the airflow generated by the first air-blowing component 802 and the second air-blowing component 803 through the first air outlet 811 and the second air outlet 812, respectively, while also completing the positioning and connection of the mounting posts and sleeves through the first mounting through hole 813 and the second mounting through hole 814, such that the cooling assistance device and the fan main body 801 form a stable assembly. The diversion groove 821 of the mounting cover 820 further guides the mixed airflow and water flow toward the target area. The third mounting through hole 822 ensures that the spray directions of the first main body 100 and the second main body 200 are consistent with the guidance path of the diversion groove 821, thereby enhancing the cooling effect. When the first air-blowing component 802 is in operation, the generated airflow is transmitted downward to the cooling assistance device, and when the second air-blowing component 803 is in operation, the generated airflow is transmitted upward to the same area. The cooling assistance device utilizes the airflow pressure differential from the first air-blowing component 802 and, through the internal channel design, atomizes and sprays the water flow without the need for a water pump drive. The sprayed mist mixes with the upper and lower layers of airflow and then diffuses into the external environment. Through the collaborative effect of the two blowing components, the mist is more evenly distributed and covers a larger area.

In some embodiments, in order to enhance the convenience and flexibility of the cooling device, the cooling assistance device, the air pump, and the water source storage device 806 may constitute a detachable cooling assistance module. This module connects the cooling assistance device and the air pump through an air pipe, and connects the cooling assistance device and the water source storage device 806 through a water pipe. When needed, the user only needs to connect the cooling assistance module to the fan in a detachable manner to activate the cooling function, which enables the user to conveniently remove the cooling assistance module when it is not needed, so as to reduce space occupation and facilitate storage and maintenance. The detachable connection may be implemented by insertion, threaded engagement, or other connection methods.

Finally, it should be noted that the above embodiments are merely used to illustrate the technical solutions of the present disclosure and not to limit them. Although the present disclosure has been described in detail with reference to the above embodiments, those of ordinary skill in the art should understand that modifications may still be made to the technical solutions described in the above embodiments, or equivalent replacements may be made for some or all of the technical features therein, and such modifications or replacements shall not cause the essence of the corresponding technical solutions to depart from the scope of the technical solutions of the present disclosure.

What is claimed is:

1. A cooling assistance device, comprising:

a first main body (100), wherein a first delivery channel (101) is provided inside the first main body (100), and a first delivery opening (102) in communication with the first delivery channel (101) is provided on one side of the first main body (100); and a second main body (200), wherein a second delivery channel (201) is provided inside the second main body (200), and a second delivery opening (202) in communication with the second delivery channel (201) is provided on one side of the second main body (200);

wherein the first delivery channel (101) is configured to deliver compressed airflow to the first delivery opening (102), and wherein, when the compressed airflow flows out from the first delivery opening (102), a negative pressure region is formed at the second delivery opening (202) such that water flow inside the second delivery channel (201) flows out from the second delivery opening (202) and is impinged to form mist by the compressed airflow flowing out of the first delivery opening;

wherein an end portion of the second main body (200) is located in front of the first delivery opening (102), the end portion of the second main body (200) is in a conical shape with a diameter that gradually decreases along a direction of the water flow, and a portion of the second delivery channel (201) corresponding to the end portion of the second main body (200) is in a conical shape with a diameter that gradually decreases along the direction of the water flow.

2. The cooling assistance device according to claim 1, wherein a central axis of the first delivery opening (102) and a central axis of the second delivery opening (202) have an included angle therebetween.

3. The cooling assistance device according to claim 1, further comprising a mounting plate (300), wherein the first main body (100) is integrally formed on the mounting plate (300), and the second main body (200) is integrally formed on the mounting plate (300) or is integrally formed on the first main body (100); wherein the first main body (100) includes a first delivery portion in a columnar shape, the second main body (200) includes a first delivery portion in a columnar shape, the first delivery portion of the second main body (200) extends in a same direction as the first delivery portion of the first main body (100), and the first delivery portions correspondingly intersect with the mounting plate (300).

4. The cooling assistance device according to claim 1, wherein the first delivery channel (101) and the second delivery channel (201) each have a first delivery portion (510) in a columnar shape and a second delivery portion (520) in a conical shape, and the second delivery portion (520) is correspondingly in communication with the first delivery opening (102) and the second delivery opening (202).

5. The cooling assistance device according to claim 1, wherein a third delivery channel (203) in communication with the second delivery channel (201) is provided at a top portion of the second main body (200), and the second delivery channel (201) and the third delivery channel (203) are in communication with a water source storage device (806) through a water source delivery device (805).

6. The cooling assistance device according to claim 1, further comprising a gas source driving member (807), wherein the first delivery channel (101) is in communication with the gas source driving member (807) through an airflow delivery device (804).

7. The cooling assistance device according to claim 3, further comprising a first assembly member (600) and a second assembly member (700), wherein the first assembly member (600) has a first mounting portion (601) for mounting the mounting plate (300) and second mounting portions (602) respectively arranged on opposite sides of the first mounting portion (601), wherein a first mounting post (603) is disposed on a side of the second mounting portion (602) adjacent to the second assembly member (700), and a second mounting post (701) is disposed on a side of the second assembly member (700) adjacent to the first assembly member (600), and the first mounting post (603) is insertable into the second mounting post (701).

8. The cooling assistance device according to claim 7, wherein the first assembly member (600) is provided with a through hole configured for the first delivery channel (101) and the second delivery channel (201) passing through, a fourth delivery channel (410) facing the first delivery channel (101) and a fifth delivery channel (420) facing the second delivery channel (201) are correspondingly provided on the second assembly member (700), the first delivery channel (101) is in communication with the fourth delivery channel (410) through a first sleeve (430), and the second delivery channel (201) is in communication with the fifth delivery channel (420) through a second sleeve (440).

9. A fan, comprising the cooling assistance device as claimed in claim 1, and comprising a fan main body (801), wherein the fan main body (801) includes a first air-blowing component (802) and a second air-blowing component (803) sequentially arranged from top to bottom.

10. The fan according to claim 9, wherein a central axis of the first delivery opening (102) and a central axis of the second delivery opening (202) have an included angle therebetween.

11. The fan according to claim 9, further comprising a mounting plate (300), wherein the first main body (100) is integrally formed on the mounting plate (300), and the second main body (200) is integrally formed on the mounting plate (300) or integrally formed on the first main body (100); wherein the first main body (100) includes a first delivery portion in a columnar shape, the second main body (200) includes a first delivery portion in a columnar shape, the first delivery portion of the second main body (200) extends in a same direction as the first delivery portion of the first main body (100), and the first delivery portions correspondingly intersect with the mounting plate (300).

12. The fan according to claim 11, further comprising a first assembly member (600) and a second assembly member (700), wherein the first assembly member (600) has a first mounting portion (601) configured to install the mounting plate (300), and second mounting portions (602) respectively arranged on opposite sides of the first mounting portion (601); wherein a first mounting post (603) is provided on a side of the second mounting portion (602) adjacent to the second assembly member (700), a second mounting post (701) is provided on a side of the second assembly member (700) adjacent to the first assembly member (600), and the first mounting post (603) is insertable into the second mounting post (701).

13. The fan according to claim 12, wherein the first assembly member (600) is provided with a through hole configured for the first delivery channel (101) and the second delivery channel (201) passing through, a fourth delivery channel (410) facing the first delivery channel (101) and a fifth delivery channel (420) facing the second delivery channel (201) are correspondingly provided on the second assembly member (700), the first delivery channel (101) is in communication with the fourth delivery channel (410) through a first sleeve (430), and the second delivery channel (201) is in communication with the fifth delivery channel (420) through a second sleeve (440).

14. The fan according to claim 9, wherein the first delivery channel (101) and the second delivery channel (201) each have a first delivery portion (510) in a columnar shape and a second delivery portion (520) in a conical shape, and the second delivery portion (520) is correspondingly in communication with the first delivery opening (102) and the second delivery opening (202).

15. The fan according to claim 9, wherein a third delivery channel (203) in communication with the second delivery channel (201) is provided at a top portion of the second main body (200), and the second delivery channel (201) and the third delivery channel (203) are in communication with a water source storage device (806) through a water source delivery device (805).

16. The fan according to claim 9, further comprising a gas source driving member (807), wherein the first delivery channel (101) is in communication with the gas source driving member (807) through an airflow delivery device (804).

17. The fan according to claim 9, further comprising an end casing (810) disposed at an air outlet end of the fan main body (801), wherein the end casing (810) is provided with a first air outlet (811) for the first air-blowing component (802) to discharge air, a second air outlet (812) for the second air-blowing component (803) to discharge air, a first mounting through hole (813) for the first mounting post (603) and the second mounting post (701) to pass through, and a second mounting through hole (814) for a corresponding sleeve to pass through, the cooling assistance device is disposed between the first air outlet (811) and the second air outlet (812), a mounting cover (820) is disposed on a side of the end casing (810) away from the first air-blowing component (802) and the second air-blowing component (803), a diversion groove (821) is arranged in a middle portion of the mounting cover (820), and a third mounting through hole (822) for the first main body (100) and the second main body (200) to pass through is correspondingly provided at a bottom and a sidewall of the diversion groove (821).

18. The cooling assistance device according to claim 1, wherein the second main body (200) has a rear end facing away from the second delivery opening (202), and the rear end of the second main body (200) is provided with an opening opposite to the second delivery opening (202).

* * * * *